US009186589B2

(12) United States Patent
Anastasia

(10) Patent No.: US 9,186,589 B2
(45) Date of Patent: Nov. 17, 2015

(54) METHOD AND SYSTEM FOR THE RAPID INFLATION OF SEALED AIR DEVICES

(71) Applicant: Super Sweet Air, Inc., Austin, TX (US)

(72) Inventor: Mark Anastasia, Orlando, FL (US)

(73) Assignee: Super Sweet Air, Inc., Austin, TX (US)

( * ) Notice: Subject to any disclaimer, the term of this patent is extended or adjusted under 35 U.S.C. 154(b) by 126 days.

(21) Appl. No.: 14/179,678

(22) Filed: Feb. 13, 2014

(65) Prior Publication Data

US 2015/0225097 A1 Aug. 13, 2015

(51) Int. Cl.

| | |
|---|---|
| ***A63G 21/18*** | (2006.01) |
| ***A47C 27/08*** | (2006.01) |
| ***F04D 19/02*** | (2006.01) |
| ***F04D 25/06*** | (2006.01) |

(52) U.S. Cl.

CPC ..... *A63G 21/18* (2013.01); *A47C 27/082* (2013.01); *F04D 19/02* (2013.01); *F04D 25/06* (2013.01); *A63B 2225/62* (2013.01)

(58) Field of Classification Search

CPC .. A63G 21/18; A47C 27/082; A63B 2225/62; F04D 17/12; F04D 19/02; F04D 25/06; B68G 7/06; E04H 2015/206

USPC ..... 53/403, 79; 141/67, 114; 417/244; 472/117, 134

See application file for complete search history.

(56) References Cited

U.S. PATENT DOCUMENTS

| | | | | | |
|---|---|---|---|---|---|
| 2,812,769 | A * | 11/1957 | Schaefer et al. | ..... | 52/2.15 |
| 3,310,818 | A * | 3/1967 | Fischer | ..... | 5/420 |
| 4,766,628 | A * | 8/1988 | Walker | ..... | 5/706 |
| 4,788,729 | A * | 12/1988 | Walker | ..... | 5/711 |
| 5,154,418 | A * | 10/1992 | Wortman | ..... | 473/109 |
| 5,398,678 | A * | 3/1995 | Gamow | ..... | 128/205.26 |
| 5,485,714 | A * | 1/1996 | Montalvo | ..... | 53/459 |
| 5,548,851 | A * | 8/1996 | Wien et al. | ..... | 4/506 |
| 5,794,289 | A | 8/1998 | Wortman et al. | | |
| 6,408,902 | B1 * | 6/2002 | Liau | ..... | 141/313 |
| 2004/0194220 | A1 * | 10/2004 | Price et al. | ..... | 5/713 |
| 2005/0107175 | A1 | 5/2005 | Field et al. | | |
| 2007/0072690 | A1 | 3/2007 | Berenson et al. | | |
| 2009/0137330 | A1 * | 5/2009 | Sefchick et al. | ..... | 472/117 |
| 2009/0211168 | A1 * | 8/2009 | Bogar | ..... | 52/2.17 |
| 2010/0120323 | A1 | 5/2010 | Boretskin | | |
| 2013/0042414 | A1 | 2/2013 | Schreiber et al. | | |
| 2015/0198168 | A1 * | 7/2015 | Tsai | ..... | F04D 19/02 |

OTHER PUBLICATIONS

International Search Report and Written Opinion issued May 12, 2015 in corresponding PCT application No. PCT/US15/14035, 9 pages.

* cited by examiner

*Primary Examiner* — Stephen F Gerrity

(74) *Attorney, Agent, or Firm* — DuBois, Bryant & Campbell LLP; William D. Wiese

(57) ABSTRACT

A method and system for the inflation of a sealed air product with accommodations for both a high capacity, low pressure blower and a low capacity, high pressure pump. The blower is attached to a fill tube and inflates the product until it approaches a point at which the pump does not have sufficient pressure to continue. The fill tube is coiled to prevent the air inside the sealed-air product from escaping and placed into a compartment behind a closable opening which is then closed. The air pump is then attached to an inflation port located on the sealed-air product which, when activated, inflates the sealed-air product to the desired air pressure. A pressure relief valves ensures the product is not over-inflated. After use, air may be allowed to escape through the fill tube, thereby allowing rapid deflation of the product.

16 Claims, 3 Drawing Sheets

METHOD AND SYSTEM FOR THE RAPID INFLATION OF SEALED AIR DEVICES

BACKGROUND OF THE INVENTION

Various embodiments of the invention provide a method and system for rapidly inflating sealed air structures. In some embodiments, this invention is directed to the sequential use of a first inflation port to initiate the inflation process and a second inflation port to complete the inflation process.

Slides and other sealed air products are commonly used on yachts, at resorts and in parks and campgrounds. These products are typically constructed with heavy-gauge reinforced vinyl, PVC-coated fabric, PVC-coated polyester, or PVC-coated nylon. The material is shaped and configured into the desired shape and then the seams are sealed using heat-sealing, hot-air welding, radio-frequency (RF) sealing, gluing, or other methods known in the art. Sealed-air products can be made in both simple and complex shapes, including, for example, slides, playgrounds, pits, hills, pyramids, climbing walls, barriers, tunnels and the like.

In addition to being configured in the desired shape, sealed air products may include inflatable stairs, handles, low friction coversheets for the slide area, water ports and other features that may enhance the desirability of using, or improve the functionality of, the product. Often the finished product is configured in multiple parts for ease in assembly and maneuverability, such as separate slide body and leg base sub-structure.

Sealed-air products known in the art are typically configured with a standard pressure relief valve. These valves may have an activation threshold of 0.5 psi or higher, but are generally in the range of 0.8 to 1.0 psi. In addition, sealed-air products are equipped with an inflation valve through which air is pumped to inflate the product.

Inflating a sealed-air product may be accomplished through the use of an electric or battery powered pump. A typical pump could be a 480 watt, 1.0 horsepower blower with grounded power cord and covered on/off switch. This type of pump could move air at 50 cfm at a maximum pressure of 2.8 psi. A battery powered pump may move air 35 cfm at a maximum pressure of 2.8 psi. To inflate the sealed-air product, one end of a hose is attached to the pump and the other end is attached to the inflation valve. When the pump is activated, the product inflates. Because of the low air output of the pump, the time required to inflate the product can be substantial—often in excess of 30 minutes for a large size product.

There is a need, therefore, for an improved sealed air apparatus inflation system which allows for the rapid inflation and deflation of a sealed-air product.

SUMMARY OF THE INVENTION

The present invention provides an improved method and system for inflating and deflating sealed-air products. A high-capacity, low pressure air blower blows through a flexible fill tube until it approaches a point at which it does not have sufficient pressure to continue. The fill tube is coiled to prevent the air inside the sealed-air product from escaping and placed in a compartment behind a closable opening which is then closed. A low capacity, high-pressure air pump is next attached to an inflation port located on the sealed-air product which, when activated, inflates the sealed-air product to the desired air pressure. After use, the closable opening is opened and the fill tube is uncoiled, thereby allowing air inside the sealed-air product to rapidly escape.

The foregoing has outlined rather broadly certain aspects of the present invention in order that the detailed description of the invention that follows may better be understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention and the advantages thereof, reference is now made to the following description taken in conjunction with the accompanying drawings in which like reference numerals indicate like features and wherein.

DETAILED DESCRIPTION OF THE INVENTION

The present invention is directed to improved methods and systems for, among other things, inflating sealed-air products. The configuration and use of the presently preferred embodiments are discussed in detail below. It should be appreciated, however, that the present invention provides many applicable inventive concepts that can be embodied in a wide variety of contexts other than sealed air products. Accordingly, the specific embodiments discussed are merely illustrative of specific ways to make and use the invention, and do not limit the scope of the invention. In addition, the following terms shall have the associated meaning when used herein:

"air blower" means a device or apparatus that outputs air at a rate in excess of 500 cfm;

"coiled" means rolled, coiled, constricted, or otherwise sealed in such a manner as to prohibit or restrict the flow of air;

"air pump" means a device or apparatus that outputs air at a rate below 500 cfm with a maximum pressure of at least 4 psi; and "sealed-air product" means any device, apparatus or product inflated with unheated air such that, when the device, apparatus or product is sealed, the air remains substantially inside.

Those skilled in the art recognize that the high-pressure, low capacity air pumps traditionally used to inflate sealed-air products are effective at inflating the product to the desired pressure, but do so at an unacceptably slow rate. Conversely, the high capacity, low pressure air blowers commonly used to inflate constant air products are not generally considered suitable for sealed-air applications because the air output pressure is not sufficient to fully inflate the sealed-air product to the desired pressure. These blowers can output air at between 750 and 1500 cfm which is a dramatic improvement over the flow rates of air pumps typically used with sealed air products. However, these high capacity pumps are not used with sealed air products because they don't possess sufficient static pressure to inflate the sealed air product to the desired firmness.

Figure 1:
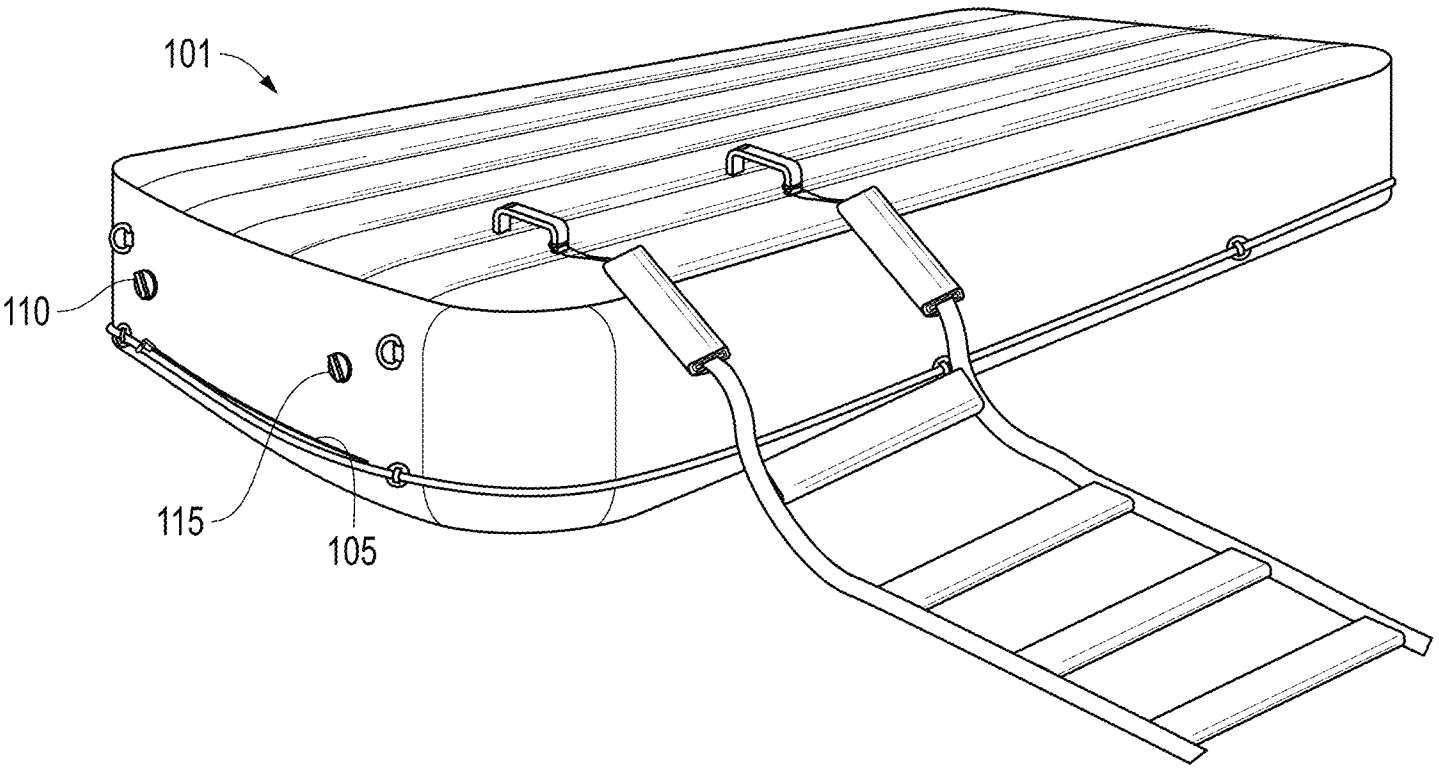
FIG. 1 is a perspective view of a sealed-air product with one embodiment of the inflation system of the present invention located behind a zipper opening.

Referring now to FIG. 1 which shows one embodiment of the present invention in which a sealed-air product 101 is configured with a flexible fill tube 102 that is located in a compartment behind a closable opening 105, for example, a zipper, and also located in proximity to a pressure relief valve 110 and an inflation valve 115. In some embodiments the closable opening 105 is water tight when it is closed. The pressure relief valve is configured to maintain a constant pressure within the sealed-air product. The pressure may be set at, for example, between 1 and 3 psi.

The fill tube 102 may have a diameter between 6 and 12 inches, but is preferably around 9 inches. The fill tube 102 may be coiled behind the closable opening 105 such that, when the opening is closed, air cannot pass through the fill tube 102. When the closable opening 105 is opened, the fill tube 102 becomes unrolled, uncoiled, unconstructed or otherwise unsealed and air freely passes through the fill tube 102.

Figure 2:
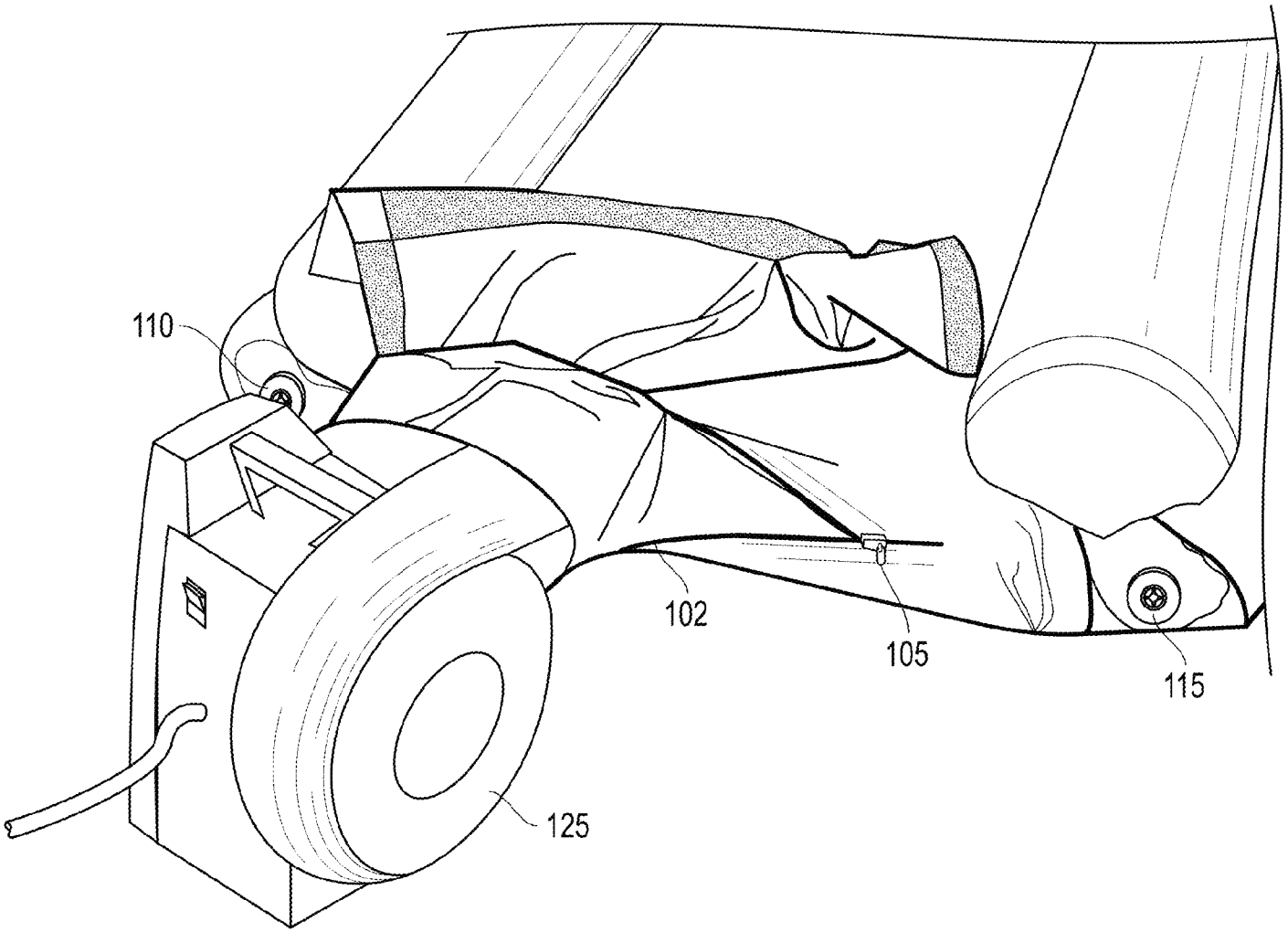
FIG. 2 is a end view of a sealed-air product with one embodiment of the inflation system of the present invention with the fill tube protruding through the closable opening.

Referring now to FIG. 2 wherein a high-output blower 125 is attached to the fill tube 102 and the inflation process commenced. The blower 125 will inflate the sealed air product 101, but will not possess sufficient static pressure to inflate it to the desired firmness. Therefore, when the blower 125 has reached a point at which it is no longer effectively moving air into the product 101, the fill tube 102 is removed from the blower 125 and is coiled and placed into the compartment behind the closable opening 105. When the closable opening 105 is closed, the fill tube 102 is secured in its coiled configuration, thereby preventing or restricting air from passing through the fill tube 102.

At this stage, although the sealed-air product 101 is "filled" with air, it is quite soft to the touch and has not reached the desired firmness. An air pump is next attached to the inflation valve 115 and activated. This connection can be made with any suitable hose known in the art such as, for example, an extra wide 1.25 inch kink-proof hose. The air pump moves air into the sealed-air product with sufficient pressure to inflate the product to the desired amount, typically around 1.0 psi. The air pump can then be removed from the inflation valve 115. This method of inflating a sealed-air product can reduce the time required for inflation by 75-80%.

The pressure relief valve 110 prevents the sealed-air product from becoming over-inflated. As the pressure reaches the designated maximum pressure of the pressure relief valve 110, the valve activates and releases pressure as long as the pressure inside the sealed-air product exceeds the maximum pressure of the pressure relief valve 110.

Embodiments of the present invention also allow the rapid deflation of the sealed-air product. To deflate the product, the closable opening 105 is opened and the fill tube 102 is removed from the compartment behind the closable opening 105 and uncoiled, thereby allowing air from inside the sealed-air product to pass through the fill tube 102. Because the diameter of the fill tube is greater than the diameter of the air egress fitting of other sealed-air products, the air escapes and the product deflates much more quickly.

Figure 3:
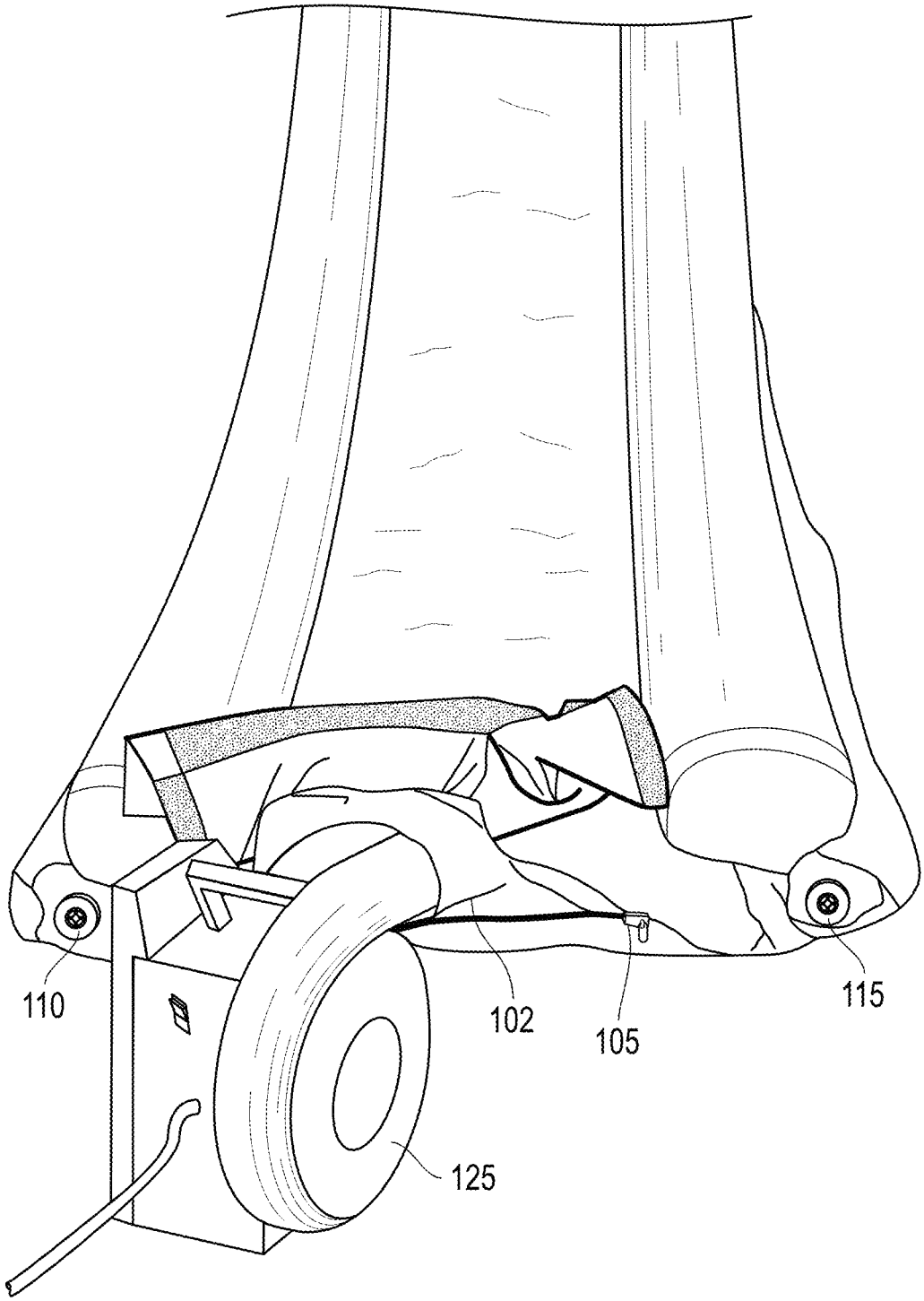
FIG. 3 is a end view of another sealed-air product with one embodiment of the inflation system of the present invention with the flexible fill tube protruding through the closable opening.

FIG. 3 depict a high-output blower 125 attached to the fill tube 102 of another type of sealed-air product. It will be appreciated by those skilled in the art that embodiments of the invention described herein may be adapted to a wide variety of sealed air products, whether or not those products are used for water-related activities, and whether or not they are used for work endeavors or recreation.

While the present system and method has been disclosed according to the preferred embodiment of the invention, those of ordinary skill in the art will understand that other embodiments have also been enabled. Even though the foregoing discussion has focused on particular embodiments, it is understood that other configurations are contemplated. In particular, even though the expressions "in one embodiment" or "in another embodiment" are used herein, these phrases are meant to generally reference embodiment possibilities and are not intended to limit the invention to those particular embodiment configurations. These terms may reference the same or different embodiments, and unless indicated otherwise, are combinable into aggregate embodiments. The terms "a", "an" and "the" mean "one or more" unless expressly specified otherwise. The term "connected" means "communicatively connected" unless otherwise defined.

When a single embodiment is described herein, it will be readily apparent that more than one embodiment may be used in place of a single embodiment. Similarly, where more than one embodiment is described herein, it will be readily apparent that a single embodiment may be substituted for that one device.

In light of the wide variety of inflation methods and systems known in the art, the detailed embodiments are intended to be illustrative only and should not be taken as limiting the scope of the invention. Rather, what is claimed as the invention is all such modifications as may come within the spirit and scope of the following claims and equivalents thereto.

None of the description in this specification should be read as implying that any particular element, step or function is an essential element which must be included in the claim scope. The scope of the patented subject matter is defined only by the allowed claims and their equivalents. Unless explicitly recited, other aspects of the present invention as described in this specification do not limit the scope of the claims.

What is claimed is:

1. A method for sealing a sealed-air product, comprising:

removing a flexible fill tube from behind a closable opening, a distal end of a flexible fill tube being connected to a sealed-air product so that air entering a proximal end of the fill tube inflates the sealed air product;

attaching a high capacity, low pressure blower to the proximal end of the fill tube;

engaging the blower, thereby inflating the sealed-air product;

removing the high capacity, low pressure blower from the proximal end of the fill tube and securing the fill tube behind the closable opening, thereby restricting air from entering the sealed-air product through the fill tube;

placing a low capacity, high pressure air pump in communication with the sealed air product so that when the pump is engaged the sealed air product inflates; and engaging the low capacity, high pressure air pump to inflate the sealed-air product to a desired pressure.

2. The method of claim 1, wherein the sealed-air product is a water slide.

3. The method of claim 1, wherein at least one panel of the sealed air product is heavy-gauged reinforced vinyl.

4. The method of claim 1, wherein at least one panel of the sealed air product is PVC coated fabric.

5. The method of claim 1, wherein the low capacity, high pressure air pump moves air at a rate below 50 cfm at a maximum pressure of at least 4.0 psi.

6. The method of claim 1, wherein the high capacity, low pressure blower moves air at a rate in excess of 500 cfm.

7. The method of claim 1, wherein the closable opening is a zipper.

8. The method of claim 1, wherein the desired pressure is around 1.0 psi.

9. A system for sealing a sealed-air product, comprising:

a fill tube in communication with a sealed-air product configured in a first position wherein a distal end of a flexible fill tube is connected to the sealed-air product in a manner that allows air entering a proximal end of the fill tube to inflate the sealed air product, and a second position wherein the distal end is positioned behind a closable opening so that air is restricted from entering the sealed-air product;

a high capacity, low pressure blower that, when attached to the proximal end of the fill tube partially inflates the sealed-air product;

a low capacity, high pressure air pump that, when placed in communication with the sealed-air product, inflates the sealed air product to a desired pressure.

10. The system of claim 9, wherein the sealed-air product is a water slide.

11. The system of claim 9, wherein at least one panel of the sealed air product is heavy-gauged reinforced vinyl.

12. The system of claim 9, wherein at least one panel of the sealed air product is PVC coated fabric.

13. The system of claim 9, wherein the low capacity, high pressure air pump moves air at a rate below 50 cfm at a maximum pressure of at least 4.0 psi.

14. The system of claim 9, wherein the high capacity, low pressure blower moves air at a rate in excess of 500 cfm.

15. The system of claim 9, wherein the closable opening is a zipper.

16. The system of claim 9, wherein the desired pressure is around 1.0 psi.

* * * * *